US006936387B2

(12) United States Patent
Yao et al.

(10) Patent No.: US 6,936,387 B2
(45) Date of Patent: Aug. 30, 2005

(54) ELECTROPHOTOGRAPHIC PHOTORECEPTOR, AND ELECTROPHOTOGRAPHIC PROCESS CARTRIDGE AND ELECTROPHOTOGRAPHIC APPARATUS USING THE SAME

(75) Inventors: Kenji Yao, Minamiashigara (JP); Wataru Yamada, Minamiashigara (JP); Kazuhiro Koseki, Minamiashigara (JP); Katsumi Nukada, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/013,540

(22) Filed: Dec. 13, 2001

(65) Prior Publication Data

US 2003/0054271 A1 Mar. 20, 2003

(30) Foreign Application Priority Data

Apr. 20, 2001 (JP) ..... 2001-123363

(51) Int. Cl.[7] ..... G03G 5/147

(52) U.S. Cl. ..... 430/66; 430/58.2; 430/67; 399/116; 399/159

(58) Field of Search ..... 430/58.2, 66, 67; 399/116, 159

(56) References Cited

U.S. PATENT DOCUMENTS

| | | | | |
|---|---|---|---|---|
| 5,430,526 | A * | 7/1995 | Ohkubo et al. | 399/159 |
| 5,879,847 | A * | 3/1999 | Yoshinaga et al. | 430/58.2 |
| 6,352,809 | B1 * | 3/2002 | Nukada et al. | 430/58.2 |
| 2002/0115012 | A1 * | 8/2002 | Hashizume et al. | 430/66 |
| 2003/0118366 | A1 * | 6/2003 | Nukada et al. | 399/109 |

FOREIGN PATENT DOCUMENTS

| | | |
|---|---|---|
| JP | A 61-238062 | 10/1986 |
| JP | A 62-108260 | 5/1987 |
| JP | A 1-161279 | 6/1989 |
| JP | A 4-273252 | 9/1992 |
| JP | A 4-346356 | 12/1992 |
| JP | A 6-75384 | 3/1994 |
| JP | A 7-311470 | 11/1995 |
| JP | A 7-333881 | 12/1995 |
| JP | A 8-319353 | 12/1996 |
| JP | A 9-190004 | 7/1997 |

OTHER PUBLICATIONS

USPTO Trademark Electronic Search System (TESS) Report for "Amberlyst." Nov. 15, 2003.*

D.S. Weiss et al., "Analysis of Electrostatic Latent Image Blurring Caused by Photoreceptor Surface Treatments," *Journal of Imaging Science and Technology,* vol. 40, No. 4, Jul./Aug. 1996.

* cited by examiner

*Primary Examiner*—Janis L. Dote
(74) *Attorney, Agent, or Firm*—Oliff & Berridge, PLC

(57) ABSTRACT

An electrophotographic photoreceptor that can sufficiently prevent occurrence of filming, whereby defects on an image can be sufficiently prevented, and an electrophotographic process cartridge and an electrophotographic apparatus using the electrophotographic photoreceptor are to be provided. The electrophotographic photoreceptor contains an electroconductive substrate having provided thereon a photosensitive layer, and an outermost layer of the photosensitive layer has a dynamic hardness of about from $13.0\times10^9$ to $100.0\times10^9$ N/m$^2$. According to the invention, occurrence of flaws on the surface of the photoreceptor can be sufficiently prevented, and cracking of a member made in contact with the photoreceptor can also be sufficiently prevented. Therefore, occurrence of filming is sufficiently prevented, and occurrence of defects on an image is also sufficiently prevented.

12 Claims, 4 Drawing Sheets

ELECTROPHOTOGRAPHIC PHOTORECEPTOR, AND ELECTROPHOTOGRAPHIC PROCESS CARTRIDGE AND ELECTROPHOTOGRAPHIC APPARATUS USING THE SAME

BACKGROUND OF THE INVENTION

1. Field of the Invention

The present invention relates to an electrophotographic photoreceptor used in an electrophotographic apparatus, such as a copier duplicator and a laser printer, and also relates to an electrophotographic process cartridge and an electrophotographic apparatus using the same.

2. Description of the Related Art

In recent years, a photoreceptor having a structure called function-separated type, in which a photosensitive layer is separated into a charge generating layer and a charge transporting layer, has been developed and subjected to practical use since it is excellent in sensitivity, repeating stability of sensitivity and electrophotographic characteristics. A electrophotographic photoreceptor having such a structure basically has two layers, i.e., a charge generating layer having a charge generating material dispersed or dissolved in a binder resin, and a charge transporting layer having a charge transporting material dispersed or dissolved in a binder resin. The charge transporting layer contains, in many cases, a hole transporting material and a thermoplastic resin, such as a polycarbonate resin, a polyester resin, an acrylic resin and a polystyrene resin, or a thermosetting resin, such as a polyurethane resin and an epoxy resin, as the binder resin. Therefore, in the case where the surface of the charge transporting layer is negatively charged by corona discharge or roller discharge, such a problem arises that the surface of the photoreceptor is largely worn by electric impacts caused by discharge.

Various investigations have been made to solve the problem. For example, as described in JP-A-161279/1989, a polishing device for an electrophotographic photoreceptor is equipped in an electrophotographic apparatus, and the polishing device is used to provide a polishing amount on the surface of the photoreceptor of from 1 $\mu$m to 1.5 $\mu$m per 10,000 printing sheets to remove contaminants on the surface; as described in JP-A-75384/1994, a photoreceptor is used in such a manner that an ozone concentration around the photoreceptor is from 5 to 50 ppm, and a abrasion amount of the photoreceptor is 300 Å or less per 1,000 revolutions; and as described in JP-A-311470/1995, a contact pressure of a cleaning blade to a photoreceptor is set at a particular value, which is used to make an abrasion amount caused by a cleaning process of from 0.05 $\mu$m to 1.0 $\mu$m per 10,000 times cleaning, and a releasing agent having a number average domain diameter of from 0.1 $\mu$m to 1.1 $\mu$m is added to a toner.

However, the methods described in the foregoing literatures can control the abrasion amount in a non-contact charging method, such as corotron and scorotron, but substantially cannot control the abrasion amount because discharge stress is large in a contact charging method, represented by roller charging, to make the abrasion amount large. Consequently, they cause a problem in that the service life of the photoreceptor is shortened. Therefore, it has been demanded to provide an electrophotographic photoreceptor having a surface with higher strength.

Polysiloxane has been known as a resin that improves the strength of the surface layer. Polysiloxane receives attention as the surface layer of an electrophotographic photoreceptor because it has not only strength, transparency, insulation breakage resistance and photostability, but also such characteristics that are not owned by other resins, such as a low surface tension. For example, a polysiloxane resin is used as a copolymerization component or a polysiloxane resin is blended with other resins, as found in a thermosetting resin containing a polysiloxane resin (JP-A-238062/1986), a polysiloxane resin (JP-A-108260/1987), a thermosetting polysiloxane resin having silica gel, a urethane resin and a fluorine resin dispersed therein (JP-A-346356/1992) and a thermoplastic resin having a thermosetting polysiloxane resin dispersed therein (JP-A-4-273252/1992).

However, although polysiloxane has the foregoing excellent characteristics, it has extremely poor compatibility with other organic compounds, and therefore, it is not used as a binder constituting the surface layer solely by itself, but is used for modification of a binder by copolymerization or blending. Therefore, the characteristics of polysiloxane cannot be fully utilized.

In order to use a polysiloxane resin as a binder for constituting the surface layer solely by itself, the following proposals have been made. Polysiloxane, such as poly (hydrogenmethylsiloxane) is directly bonded to a charge transporting agent having an unsaturated bond by hydrosilylation to form a resin, which is used for forming the surface layer (JP-A-319353/1996); an inorganic thin film is formed by plasma CVD (JP-A-333881/1995); a thin film is formed by a sol-gel process ("Proceedings of IS&T's Eleventh International Congress on Advances in Non-Impact Printing Technologies", pp. 57 to 59); and the surface layer is formed by using an organic silicon-modified hole transporting compound, which is formed by directly introducing a silicon compound having a hydrolyzable group into a charge transporting agent (JP-A-190004/1997).

Among the foregoing methods, those described in "Proceedings of IS&T's Eleventh International Congress on Advances in Non-Impact Printing Technologies", p. 57 to 59 and JP-A-190004/1997 are receiving attention because siloxane forms a three-dimensional network to attain high mechanical strength.

However, in the case where a thin film formed by the sol-gel process or a product formed by crosslinking the organic silicon-modified hole transporting compound is used as the outermost layer of the photosensitive layer, filming, i.e., attachments accumulated on the surface of the photoreceptor, often occurs, and thus there are some cases where defects are formed on an image.

SUMMARY OF THE INVENTION

The invention has been made in view of the foregoing circumstances. Consequently, the invention provides an electrophotographic photoreceptor that can sufficiently prevent occurrence of filming, whereby defects on an image can be sufficiently prevented, and also provides an electrophotographic process cartridge and an electrophotographic apparatus using the electrophotographic photoreceptor.

As a result of earnest investigations made by the inventors, they have considered that the mechanisms causing the problem are as follows. That is, flaws are formed on the surface of the photoreceptor due to an external stress caused, for example, by a cleaning blade, and products formed by discharge and moisture are attached to the flaws. Fine particles, such as an external additive for a toner, are attached and accumulated (i.e., filming) thereon to cause defects on an image. In particular, because polysiloxane contains a large amount of non-reacted hydroxyl groups, adsorption of products formed by corona discharge and moisture is liable to occur, and this tendency is increased when the amount of flaws is larger on the surface of the photoreceptor caused by stress of cleaning.

As a result of earnest investigations further made by the inventors to solve the problem, it has been found that when the outermost layer of the photosensitive layer has a dynamic hardness in a particular range, occurrence of flaws on the surface can be sufficiently prevented, whereby the problem can be solved. Thus, the invention has been completed.

According to an aspect, the invention relates to an electrophotographic photoreceptor containing an electroconductive substrate having provided thereon a photosensitive layer, an outermost layer of the photosensitive layer having a dynamic hardness of about from $13.0\times10^9$ N/m$^2$ to $100.0\times10^9$ N/m$^2$.

In the case where the electrophotographic photoreceptor according to the invention is used as a photoreceptor of an electrophotographic apparatus, even though a member made in contact with the surface of the electrophotographic photoreceptor (such as a cleaning blade) is provided, occurrence of flaws on the surface of the photoreceptor can be sufficiently prevented, and cracks of the member made in contact with the surface of the photoreceptor can also be sufficiently prevented. Therefore, occurrence of filming can be sufficiently prevented.

According to another aspect, the invention relates to an electrophotographic process cartridge containing the electrophotographic photoreceptor and at least one device selected from the group consisting of a charging device, an exposing device, a developing device and a cleaning device, integrated with each other, the process cartridge being detachable on an electrophotographic apparatus main body.

According to the invention, in the case where the process cartridge is installed in an electrophotographic apparatus main body to constitute an electrophotographic apparatus, occurrence of flaws on the surface of the photoreceptor can be sufficiently prevented, and cracks of the member made in contact with the surface of the photoreceptor can also be sufficiently prevented. Therefore, occurrence of filming can be sufficiently prevented.

According to a further aspect, the invention relates to an electrophotographic apparatus containing the electrophotographic photoreceptor, a charging device for charging the electrophotographic photoreceptor, an exposing device for exposing a surface of the electrophotographic photoreceptor to form an electrostatic latent image, a developing device for developing the electrostatic latent image, a transferring device for transferring an image thus developed to a transfer medium, and a cleaning device being arranged to be made in contact with the surface of the electrophotographic photoreceptor after transferring and having a cleaning member for cleaning the surface.

According to the invention, even when the cleaning member is made in contact with the surface of the electrophotographic photoreceptor, occurrence of flaws on the surface of the photoreceptor can be sufficiently prevented, and cracks of the cleaning member can also be sufficiently prevented. Therefore, occurrence of filming can be sufficiently prevented.

BRIEF DESCRIPTION OF THE DRAWINGS

Preferred embodiments of the invention will be described in detail based on the following figures, wherein.

DESCRIPTION OF THE PREFERRED EMBODIMENTS

Figure 1:
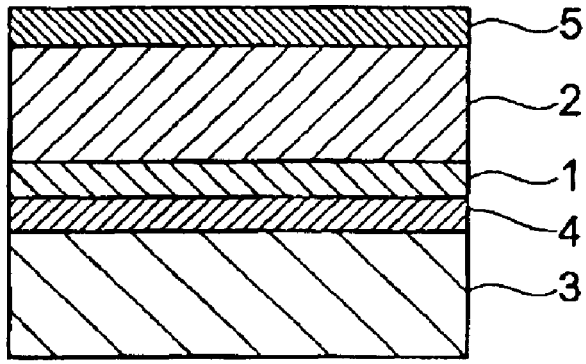
FIG. 1 is a cross sectional view showing a first example of an electrophotographic photoreceptor having a function-separated type structure.

The invention will be described in detail below.

Electrophotographic Photoreceptor

The electrophotographic photoreceptor according to the invention will be described below.

The electrophotographic photoreceptor of the invention contains an electroconductive substrate having provided thereon a photosensitive layer, and an outermost layer of the photosensitive layer has a dynamic hardness of about from $13.0\times10^9$ to $100.0\times10^9$ N/m$^2$.

As one of the mechanisms of occurrence of filming on the outermost layer of the photosensitive layer, it is considered that flaws are formed on the surface of the photoreceptor due to an external stress, such as a cleaning blade, and products formed by discharge are attached to the flaws, to which an external additive for a toner are attached. When the dynamic hardness of the outermost layer of the electrophotographic photoreceptor is less than $13.0\times10^9$ N/m$^2$, flaws are formed due to insufficient hardness to cause considerable filming. When the dynamic hardness exceeds $100.0\times10^9$ N/m$^2$, on the other hand, the hardness becomes too large to crack a member made in contact with the electrophotographic photoreceptor (for example, a charging roller and a cleaning blade), and filming occurs thereby to cause deterioration in image quality. When the dynamic hardness of the outermost layer of the electrophotographic photoreceptor is in a range of about from $13.0\times10^9$ to $100.0\times10^9$ N/m$^2$, occurrence of flaws on the surface of the photoreceptor is sufficiently prevented, and products formed by discharge are difficult to be attached. Furthermore, cracking of the contacting member is also sufficiently prevented, and such a phenomenon can be sufficiently prevented that products formed by discharge attached on the surface of the photoreceptor are not removed by the contacting member but are accumulated thereon. Therefore, occurrence of filming can be sufficiently prevented, and thus occurrence of image defects can be sufficiently prevented.

The dynamic hardness of the outermost layer of the photosensitive layer is preferably about from $15.0\times10^9$ to $70.0\times10^9$ N/m$^2$, and more preferably about from $20.0\times10^9$ to $50.0\times10^9$ N/m$^2$.

The dynamic hardness referred in the invention is defined as follows. A diamond penetrator having a tip angle of 115° and a tip curvature radius of 0.1 $\mu$m or less is penetrated onto the surface of the electrophotographic photoreceptor with a stress velocity of 0.05 mN/sec, and the dynamic hardness is calculated from the penetrating load and the penetrating depth by using the following equation (1):

$$DH=3.8584\times(P/D^2) \quad (1)$$

wherein DH represents the dynamic hardness (N/m$^2$), P represents the penetrating load (N), and D represents the penetrating depth (m). The diamond penetrator used herein is one equipped on a micro hardness tester (DUH-201, produced by Shimadzu Corp.). The penetrating depth is read from the displacement of the penetrator, and the penetrating load is read from a load cell attached to the penetrator.

The dynamic hardness measured according to the definition has higher correlation with filming.

However, in the case where a layer under the outermost layer of the photoreceptor is extremely soft, it is difficult to calculate the dynamic hardness in the foregoing manner. In such a case, the following method is employed instead of the foregoing one, and a hardness calculated by the following method is defined as the dynamic hardness of the outermost layer.

A layer having the same composition as the outermost layer of the photoreceptor is coated on a glass substrate by a dip coating method, a bar coater coating method, a spray coating method or a vapor deposition method to a film thickness of about from 1.0 to 10.0 $\mu$m. The microhardness measuring apparatus described above is prepared, and a diamond penetrator equipped on the apparatus is penetrated onto the layer with a stress velocity of 0.14 mN/sec. At this time, the penetrating depth is read from the displacement of the penetrator, and the penetrating load is read from a load cell attached to the penetrator. The dynamic hardness is calculated from the penetrating load and the penetrating depth by using the equation (1).

Outermost Layer

The outermost layer used in the invention may contain a three-dimensionally crosslinked silicone resin and has a charge transporting property. It is constituted with a three-dimensionally crosslinked silicone resin having a low molecular weight charge transporting compound dispersed therein or a three-dimensionally crosslinked silicone resin having a charge transporting organic group.

Among these, the outermost layer is preferably constituted with a three-dimensionally crosslinked silicone resin having a charge transporting organic group because local fluctuation of the surface hardness can be prevented.

The three-dimensionally crosslinked silicone resin can be obtained in the following manner. At least one kind of a charge transporting organic silicon compound represented by the following general formula (I) and a trifunctional or tetrafunctional silicon compound are hydrolyzed, and then the hydrolyzed product is crosslinked to obtain the three-dimensionally crosslinked silicone resin. In this case, an outermost layer having a dynamic hardness within the foregoing range can be obtained, whereby occurrence of filming can be sufficiently prevented, and the mechanical durability is improved.

$$W\text{-}(D\text{-}SiR_{3-a}Q_a)_b \quad (I)$$

wherein W represents a charge transporting organic group, D represents a divalent functional group, R represents a hydrogen atom, an alkyl group or a substituted or unsubstituted aryl group, Q represents a hydrolyzable group, a represents an integer of from 1 to 3, and b represents an integer of from 1 to 4.

The charge transporting organic group represented by W in the general formula (I) is not particularly limited as far as it has a charge transporting property, and examples thereof include those having such a structure as a triarylamine structure, a benzidine structure, an arylalkane structure, an aryl-substituted ethylene structure, a stilbene structure, an anthracene structure and a hydrazone structure.

The divalent functional group represented by D in the general formula (I) is a group for directly combining the group W imparting photoelectric characteristics to the three-dimensional inorganic vitreous network. The divalent functional group also imparts suitable flexibility to the inorganic vitreous network, which is rigid but is brittle, to improve the strength of the film. Specific examples of the divalent functional group include $—C_nH_{2n}—$, $C_nH_{(2n-2)}—$, $—C_nH_{(2n-4)}—$ (wherein n represents an integer of from 1 to 15), a divalent hydrocarbon group represented by $—CH_2—C_6H_4—$ or $—C_6H_4—C_6H_4—$, an oxycarbonyl group (—COO—), a thio group (—S—), an oxy group (—O—), an isocyano group (—N═CH—) and a divalent group formed by combining two or more of these groups. These divalent groups may have a substituent, such as an alkyl group, a phenyl group, an alkoxy group and an amino group, on the side chain thereof.

The Si group in the general formula (I) is to form a three-dimensional siloxane bond (Si—O—Si bond), i.e., the inorganic vitreous network, through a mutual crosslinking reaction.

In the general formula (I), R represents a hydrogen atom, an alkyl group or a substituted or unsubstituted aryl group.

The hydrolyzable group represented by Q in the general formula (I) is a functional group capable of forming a siloxane bond (Si—O—Si) in a curing reaction of the hydrolyzed product of the charge transporting organic silicon compound represented by the general formula (I). Preferred examples of the hydrolyzable group include a hydroxyl group, an alkoxy group, a methyl ethyl ketoxime group, a diethylamino group, an acetoxy group, a propenoxy group and a chloro group, and among these, a group represented by —OR' (wherein R' represents an alkyl group having from 2 to 15 carbon atoms or a trimethylsilyl group having from 1 to 4 carbon atoms) is more preferred. By using the charge transporting organic silicon compound having the hydrolyzable group, such advantages can be obtained that high curing reactivity and high stability can be obtained.

The trifunctional or tetrafunctional silicon compound is used for increasing the hardness of the resulting three-dimensionally crosslinked silicone resin to such a level that is higher than the case where only the hydrolyzed product of the charge transporting organic silicon compound represented by the general formula (I) is crosslinked. Specific examples of the trifunctional silicon compound include triethoxysilane, trimethoxysilane and triisopropoxysilane, and specific examples of the tetrafunctional compound include tetramethoxysilane, tetraethoxysilane and tetraisopropoxysilane. The addition amount of the trifunctional or tetrafunctional compound is generally from 0.1 to 20 parts by weight, and preferably from 0.5 to 5 parts by weight, per 100 parts by weight of the charge transporting organic silicon compound represented by the general formula (I). When the addition amount thereof is less than 0.1 part by weight, the hardness is in short, and flaws are liable to occur on the outermost layer, so as to cause considerable filming. When it exceeds 20 parts by weight, on the other hand, there are some cases where a member made in contact with the photoreceptor (such as a charging roll and a cleaning blade) is cracked to fail to remove the attachments on the surface of the photoreceptor, whereby filming occurs.

Water is further added upon hydrolysis of the charge transporting silicon compound represented by the general formula (I) and the trifunctional or tetrafunctional silicon compound. The addition amount of water is not particularly limited, and it is preferably from 30 to 500%, and more preferably from 50 to 300%, based on the theoretical amount for hydrolyzing the entire hydrolyzable groups of the materials containing the hydrolyzable silicon substituent represented by $—SiR_{3-a}Q_a$ because it influences on the storage stability of the product and suppression of gelation upon polymerization. When the amount of water exceeds 500%, there is a tendency that the storage stability of the product becomes poor, or the charge transporting organic silicon compound is liable to be deposited. When the amount of water is less than 30%, on the other hand, there is a tendency that the amount of the unreacted compound is increased, whereby phase separation occurs upon coating or curing a coating composition for forming the outermost layer, and the strength is lowered.

In the case where the film forming property and the flexibility of the film are adjusted, another coupling agent and a fluorine compound may be mixed depending on necessity upon hydrolysis of the charge transporting silicon compound represented by the general formula (I) and the trifunctional or tetrafunctional silicon compound. Examples of the coupling agent include various kinds of silane coupling agents, and examples of the fluorine compound include a commercially available silicone hardcoating agent.

Upon hydrolysis of the charge transporting silicon compound represented by the general formula (I) and the trifunctional or tetrafunctional silicon compound, it is preferred to add a polymer having a substituted silicon group represented by $—SiR_{3-a}Q_a$ and having a molecular weight of 1,000 or more. The polymer enables adjustment of the viscosity of the resulting three-dimensionally crosslinked resin and is effective for controlling the film thickness. The polymer can be synthesized by polymerizing a monomer having a substituted silicon group represented by $—SiR_{3-a}Q_a$ with a polymerization initiator, such as azobisisobutyronitrile and benzoyl peroxide, added. Examples of the monomer include methacryloxypropyltrimethoxysilane, methacryloxypropyltriethoxysilane, methacryloxypropylmethyldimethoxysilane and styrylethyltrimethoxysilane. Upon synthesis a copolymer may be produced by mixing a monomer, such as methyl methacrylate, methyl acrylate, styrene and acrylonitrile, in an arbitrary ratio, with the monomer having a substituted silicon group represented by $—SiR_{3-a}Q_a$. The molecular weight thereof is preferably 1,000 or more in terms of styrene because the mechanical strength is decreased when the molecular weight is too low. The molecular weight is preferably 2,000,000 or less in terms of styrene because the viscosity of the solution is difficult to be adjusted when the molecular weight is too high.

The hydrolysis of the charge transporting organic silicon compound represented by the general formula (I) and the trifunctional or tetrafunctional silicon compound can be carried out by using a solvent depending on necessity. Examples of the solvent include an alcohol, such as methanol, ethanol, propanol and butanol, a ketone, such as acetone and methyl ethyl ketone, and an ether, such as tetrahydrofuran, diethyl ether and dioxane. These solvents may be used solely or after arbitrary mixing. In the case where a solvent is used, it is preferred to use a solvent having a boiling point of 150° C. or less (examples of which include an alcohol, such as methanol, ethanol, propanol and butanol, a ketone, such as acetone and methyl ethyl ketone, and an ether, such as tetrahydrofuran). The solvent is preferably an alcohol from the standpoint that the storage stability of the hydrolyzed product thus formed is improved.

The amount of the solvent may be arbitrarily determined and is generally from 0.5 to 30 parts by weight, and preferably from 1 to 20 parts by weight, per 1 part by weight of the charge transporting organic silicon compound represented by the general formula (I) because the charge transporting organic silicon compound is liable to be deposited when the amount of the solvent is too small, and the viscosity is lowered to deteriorate the coating formability when the amount thereof is too large.

A solid catalyst is generally used upon hydrolysis of the charge transporting organic silicon compound represented by the general formula (I) and the trifunctional or tetrafunctional silicon compound. The solid catalyst is to accelerate the hydrolysis reaction and is not particularly limited as far as it is insoluble in all the charge transporting organic silicon compound represented by the general formula (I), the trifunctional or tetrafunctional silicon compound, the coupling agent, the fluorine compound, water, the reaction product and the solvent. Examples of the solvent include a cation exchange resin, such as AMBERLITE 15, AMBERLITE 200C, AMBERLYST 15 and AMBERLYST 15 E (all produced by Rohm and Haas, Inc.), DOWEX MWC-1H, DOWEX 88 and DOWEX HCR-W2 (all produced by Dow Chemical, Inc.), LEWATIT SPC-108 and LEWATIT SPC-118 (all produced by Bayer AG), DIANION RCP-150H (produced by Mitsubishi Chemical Co., Ltd.), SUMIKAION KC-470, DUOLITE C26 -C, DUOLITE C-433 and DUOLITE 464 (all produced by Sumitomo Chemical Co., Ltd.), and NAFION H (produced by Du Pont, Inc.);

an anion exchange resin, such as AMBERLITE IRA-400 and AMBERLITE IRA-45 (all produced by Rohm and Haas, Inc.);

an inorganic solid having a group containing a protonic acid group bound on the surface thereof, such as $Zr(O_3PCH_2CH_2SO_3H)_2$ and $Th(O_3PCH_2CH_2COOH)_2$;

a polyorganosiloxane containing a protonic acid group, such as polyorganosiloxane containing a sulfonic acid group; a heteropolyacid, such as cobalt-tungstic acid and phosphorous-molybdic acid; an isopolyacid, such as niobic acid, tantalic acid and molybdic acid; a monoelemental metallic oxide, such as silica gel, alumina, chromia, zirconia calcium oxide (CaO) and magnesium oxide (MgO);

a complex metallic oxide, such as silica-alumina, silica-magnesia, silica-zirconia and zeolite;

a clay mineral, such as acid clay, activated clay, montmorillonite and kaolinite;

a metallic sulfate, such as lithium sulfate ($LiSO_4$) and magnesium sulfate ($MgSO_4$); a metallic phosphate, such as zirconium phosphate and lanthanum phosphate; a metallic nitrate, such as lithium nitrate ($LiNO_3$) and manganese nitrate ($Mn(NO_3)_2$);

a inorganic solid having a group containing an amino group bonded on the surface thereof, such as a solid obtained by reacting aminopropyltriethoxysilane on silica gel; and a polyorganosiloxane containing an amino group, such as an amino-modified silicone resin.

The solid catalyst may be placed on a fixed bed, and the reaction may be carried out by a continuous system or may be carried out by a batch system. The using amount of the solid catalyst is not particularly limited and is preferably from 0.001 to 20% by weight, and particularly from 0.01 to 10% by weight, based on the total amount of the materials containing the hydrolyzable silicon substituent ($—SiR_{3-a}Q_a$).

The charge transporting organic silicon compound represented by the general formula (I), the trifunctional or tetrafunctional compound, water, the solvent, the polymer having a substituted silicon group having a hydrolyzable group represented by $—SiR_{3-a}Q_a$, the coupling agent, the fluorine compound and the solid catalyst may be mixed all at once and subjected to hydrolysis. Alternatively, they may be added one after another to adjust the extent of hydrolysis, or part of may be added after removing the solid catalyst. In the case where the polymer having a substituted silicon group having a hydrolyzable group represented by $—SiR_{3-a}Q_a$ is added, however, gelation is extremely accelerated when the solid catalyst and the polymer coexist to complicate the coating operation of a coating composition for forming the outermost layer, and therefore, it is preferred that the polymer is added after removing the solid catalyst. In this case, it is effective to improve the compatibility of the coating film that the coating composition is allowed to stand (aged) for 1 hour or more after removing the solid catalyst until coating. The period of time for allowing to stand is preferably from 1 to 250 hours, and more preferably from 2 to 200 hours.

The hydrolysis reaction is generally carried out at a temperature of from 0 to 100° C., preferably from 5 to 70° C., and particularly preferably from 10 to 50° C., while depending on the species of the raw materials. The reaction time is not particularly limited, but there is a tendency that gelation is liable to occur when the reaction time is too long, whereas there is a tendency that the reaction becomes insufficient when the reaction time is too short. Therefore, it is preferred that the reaction time is in a range of from 10 minutes to 100 hours.

After carrying out the hydrolysis reaction, a curing catalyst is added to the hydrolyzed product to obtain a coating composition for forming the outermost layer. Examples of the curing catalyst include a protonic acid, such as hydrochloric acid, acetic acid, phosphoric acid and sulfuric acid; a base, such as ammonia and triethylamine; an organic tin compound, such as dibutyltin diacetate, dibutyltin dioctoate and stannous octoate; an organic titanium compound, such as tetra-n-butyl titanate and tetraisopropyl titanate; an organic aluminum compound, such as aluminum tributoxide and aluminum triacetylacetonate; and an iron salt, a manganese salt, a cobalt salt, a zinc salt and a zirconium salt of an organic carboxylic acid. Among these, a metallic compound is preferred, and an acetylacetonate and an acetylacetate of a metal are more preferred, from the standpoint of the storage stability of the coating composition for forming the outermost layer. The using amount of the curing catalyst may be arbitrarily determined and is preferably from 0.1 to 20% by weight, and more preferably from 0.3 to 10% by weight, based on the total amount of the materials containing a hydrolyzable silicon substituent from the standpoint of the storage stability, the characteristics and the strength.

Upon forming the outermost layer, in general, the coating composition for the outermost layer is coated on a charge transporting layer or a charge generating layer, and then crosslinked by heat to be cured. Examples of the coating method that can be used herein include ordinary coating methods, such as a blade coating method, a Mayer-bar coating method, a spray coating method, a dip coating method, a bead coating method, an air-knife coating method and a curtain coating method. In the case where a necessary film thickness cannot be obtained by a single coating operation, the coating operation may be repeated in plural times to obtain the necessary film thickness. In the case where the coating operation is repeated in plural times, a heat treatment may be carried out for the respective coating operations or may be carried out once after all the plural coating operations.

The curing temperature may be arbitrarily determined and is preferably set at 140° C. or more, and more preferably at 150° C. or more, in order to obtain a desired strength. The curing time may be arbitrarily determined depending on necessity and is preferably from 10 minutes to 5 hours. It is also effective that the coating film is maintained in a high humidity condition after carrying out the curing reaction to stabilize the characteristics thereof. The high humidity condition referred herein means a condition having a relative humidity (RH) of from 80 to 95%. A surface treatment may be carried out, depending on necessity, by using hexamethyldisilazane or trimethylchlorosilane to make the surface hydrophobic from the standpoint of the stability of the composition.

In the coating composition for forming the outermost layer, organic fine particles or inorganic fine particles may be contained from the standpoint of improvement of the hardness of the outermost layer, improvement of the surface lubricity and prevention of cracks. Examples of the organic fine particles include polytetrafluoroethylene (PTFE) and polystyrene. Organic particles having a reactive group, such as a hydroxyl group, on the surface thereof, as described in "Preprints of The 8th Polymer Material Forum, 1PC06 (1999)", are preferred because they are excellent in dispersibility, and a uniform film with high strength can be easily obtained. Examples of the inorganic fine particles include $TiO_2$, $SiO_2$ and ZnO.

When the mechanical strength of the surface of the photoreceptor is increased to prolong the service life of the photoreceptor, the photoreceptor is in contact with an oxidizing gas in a long period of time, and thus the outermost layer is required to have a higher oxidation resistance than the related art product. Therefore, in order to prevent deterioration of the photoreceptor due to ozone and an oxidizing gas formed inside the duplicator or due to light and heat, it is preferred to add such an additive as an antioxidant, a photostabilizer and a heat stabilizer to the coating composition for forming the outermost layer. Examples of the antioxidant include hindered phenol, hindered amine, paraphenylenediamine, arylalkane, hydroquinone, spirochroman, spiroindanone, a derivative of them, an organic sulfur compound and an organic phosphorous compound. Examples of the photostabilizer include a derivative of benzophenone, benzotriazole, dithiocarbamate and tetramethylpiperidine. The addition amount thereof is preferably 15% by weight or less, and more preferably 10% by weight or less, based on the total solid content of the coating composition for forming the outermost layer.

Furthermore, various kinds of lubricants may be added to the coating composition for forming the outermost layer in order to reduce the friction force caused by contacting with a cleaning blade and a contact charging device. The lubricant is not particularly limited and known products may be used. Specific examples thereof include a silicon oil, colloidal silica, hydrophobic silica, spherical silsesquioxane and polytetrafluoroethylene.

In the case where the outermost layer is used as an overcoat layer on a charge transporting layer, the thickness thereof is generally from 0.5 to 10 $\mu$m, and preferably from 0.7 to 8 $\mu$m.

The outermost layer used in the invention has an excellent mechanical strength and also sufficient photoelectric characteristics, and therefore, it can be used as a charge transporting layer of a multi-layer photoreceptor.

While the case where the outermost layer contains the three-dimensionally crosslinked silicone resin having a charge transporting organic group has been described, the outermost layer may also be constituted with a three-dimensionally crosslinked silicone resin having a low molecular weight charge transporting compound dispersed therein, as described in the foregoing.

In this case, the three-dimensionally crosslinked silicone resin can be obtained in the following manner. That is, it can be formed by reacting a system containing a silicon compound having at least three functional groups and a charge transporting substance, so as to carry out crosslinking.

The silicon compound having at least three functional groups is represented by the following general formulae (A) and (B):

$$Si(Z)_4 \quad (A)$$

$$R^1—Si(A)_3 \quad (B)$$

wherein $R^1$ represents an organic group in the form of directly bonding a carbon atom thereof to the silicon atom in the formula, and Z represents a hydroxyl group or a hydrolyzable group.

In the case where Z in the general formulae (A) and (B) represents a hydrolyzable group, examples of the hydrolyzable group include a methoxy group, an ethoxy group, a methyl ethyl ketoxym group, a diethylamino group, an acetoxy group, a propenoxy group, a propoxy group, a butoxy group, and a methoxyethoxy group. Examples of the organic group in the form of directly bonding a carbon atom thereof to the silicon atom in the formula represented by $R^1$ include an alkyl group, such as methyl, ethyl, propyl and butyl, an aryl group, such as phenyl, tolyl, naphthyl and biphenyl, an epoxy-containing group, such as γ-glycidoxypropyl and β-(3,4-epoxycyclohexyl)ethyl, a (meth)acryloyl-containing group, such as γ-acryloxypropyl and γ-methacryloxypropyl, a hydroxyl-containing group, such as γ-hydroxypropyl and 2,3-dihydroxypropyloxypropyl, a vinyl-containing group, such as vinyl and propenyl, a mercapto-containing group, such as γ-mercaptopropyl, an amino-containing group, such as γ-aminopropyl and N-β-(aminoethyl)-γ-aminopropyl, and a halogen-containing group, such as γ-chloropropyl, 1,1,1-trifluoropropyl, nonafluorohexyl and perfluorooctylethyl, as well as a nitro group and a cyano-substituted alkyl group.

Specific examples of the charge transporting material include a hole transporting substance, such as an oxadiazole derivative, a pyrazoline derivative, an aromatic tertiary amino compound, an aromatic tertiary diamino compound, a 1,2,4-triazine derivative, a hydrozone derivative, a quinazoline derivative, a benzofuran derivative, an α-stilbene derivative, an enamine derivative, a carbazole derivative, a poly-N-vinylcarbazole and a derivative thereof; an electron transporting substance, such as a quinone compound, a tetracyanoquinodimethane compound, a fluorenone compound, an oxadiazole compound, a xanthone compound, a thiophene compound and a diphenoquinone compound; and a polymer having a group derived from these compounds on a main chain or a side chain thereof. These charge transporting substances may be used solely or in combination of two or more of them.

The additives to the coating composition and the film forming conditions may be the same as those described for the three-dimensionally crosslinked silicone resin having a charge transporting organic group.

Layer Structure of Electrophotographic Photoreceptor

A specific layer structure of the electrophotographic photoreceptor according to the invention will be described below.

Figure 2:
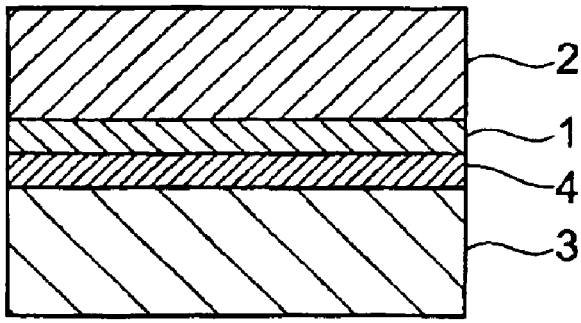
FIG. 2 is a cross sectional view showing a second example of an electrophotographic photoreceptor having a function-separated type structure.
Figure 3:
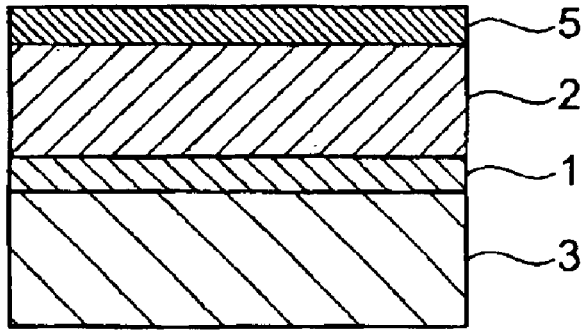
FIG. 3 is a cross sectional view showing a third example of an electrophotographic photoreceptor having a function-separated type structure.
Figure 4:
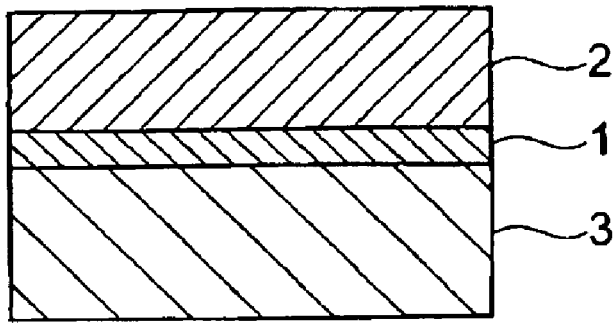
FIG. 4 is a cross sectional view showing a fourth example of an electrophotographic photoreceptor having a function-separated type structure.
Figure 5:
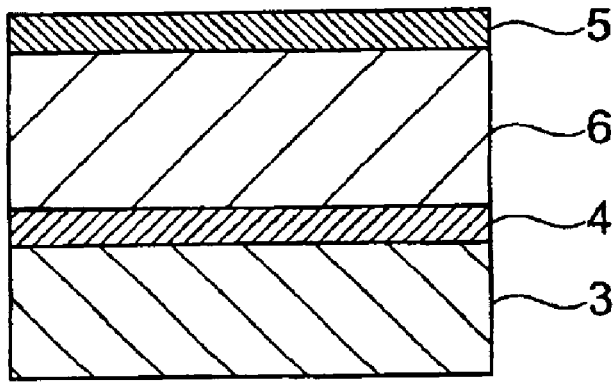
FIG. 5 is a cross sectional view showing a first example of an electrophotographic photoreceptor having a single layer structure.
Figure 6:
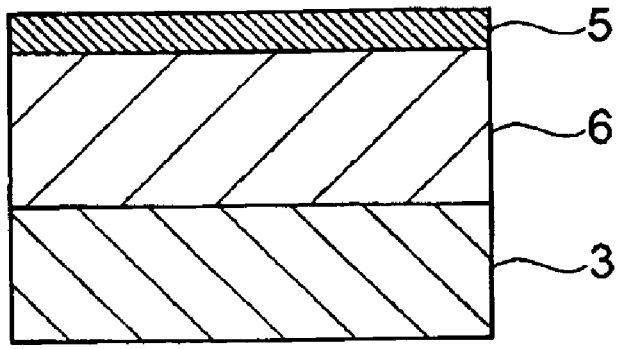
FIG. 6 is a cross sectional view showing a second example of an electrophotographic photoreceptor having a single layer structure.
Figure 7:
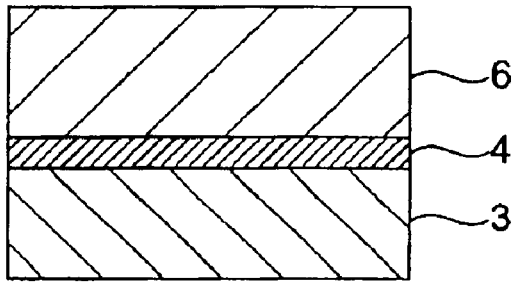
FIG. 7 is a cross sectional view showing a third example of an electrophotographic photoreceptor having a single layer structure.
Figure 8:
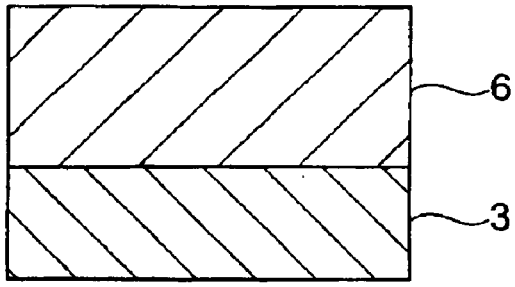
FIG. 8 is a cross sectional view showing a fourth example of an electrophotographic photoreceptor having a single layer structure.

FIGS. 1 to 7 are cross sectional views showing various kinds of layer structures of the electrophotographic photoreceptor according to the invention. FIG. 1 shows a photosensitive layer containing an undercoating layer 4, a charge generating layer 1, a charge transporting layer 2 and a protective layer 5 provided on an electroconductive substrate 3 in this order. FIG. 2 shows a constitution obtained by removing the protective layer 5 from the photosensitive layer shown in FIG. 1. FIG. 3 shows a constitution obtained by removing the undercoating layer 4 from the photosensitive layer shown in FIG. 1. FIG. 4 shows a constitution obtained by removing the protective layer 5 from the photosensitive layer shown in FIG. 3. FIG. 5 shows a photosensitive layer containing an undercoating layer 4, a layer having a charge generating function and a charge transporting function 6 and a protective layer 5 provided on an electroconductive support 3 in this order. FIG. 6 shows a constitution obtained by removing an undercoating layer 4 from the photosensitive layer shown in FIG. 5. FIG. 7 shows a constitution obtained by removing the protective layer 5 from the photosensitive layer shown in FIG. 5. FIG. 8 shows a constitution obtained by removing the undercoating layer 4 from the photosensitive layer shown in FIG. 7. The electrophotographic photoreceptor of the invention may have any of these layer structures.

In the structures shown in FIGS. 1, 3, 5 and 6, the protective layer 5 is the outermost layer of the photosensitive layer; in FIGS. 2 and 4, the charge transporting layer 2 is the outermost layer of the photosensitive layer; and in FIGS. 7 and 8, the layer having a charge generating function and a charge transporting function 6 is the outermost layer of the photosensitive layer.

The electroconductive substrate 3, the undercoating layer 4, the charge generating layer 1, the charge transporting layer 2 and the layer having a charge generating function and a charge transporting function 6 of the electrophotographic photoreceptor will be described below.

Electroconductive Substrate

As the electroconductive substrate 3, known materials can be used, examples of which include a metallic drum, such as aluminum, copper, iron, zinc and nickel; a sheet, paper, plastics or glass having vapor-deposited thereon a metal, such as aluminum, copper, gold, silver, platinum, palladium, titanium, a nickel-chromium alloy, stainless steel and a copper-indium alloy; a sheet, paper, plastics or glass having vapor-deposited thereon an electroconductive metallic compound, such as indium oxide and tin oxide; a sheet, paper, plastics or glass having laminated thereon a metallic foil; and a sheet, paper, plastics or glass having been subjected to an electroconductive treatment by coating a binder resin having dispersed therein carbon black, indium oxide, tin oxide-antimony oxide powder, metallic powder or copper iodide.

In the case where a metallic drum is used as the electroconductive support 3, a metallic drum may be used as it is without any treatment, but it may be previously subjected to a surface treatment, such as mirror cutting, etching, anodic oxidation, coarse cutting, centerless polishing, sand blasting and wet honing. An electroconductive support having been subjected to a surface treatment is preferably used. In this case, the substrate has a coarse surface, and thus woodgrain density unevenness (moiré fringes) can be prevented, which is caused by interference light that may occur inside the photosensitive layer when a coherent light source, such as a laser beam, is used.

Undercoating Layer

The undercoating layer 4 may be constituted with a polymer compound solely, or may be constituted with a polymer compound having fine particles dispersed therein or a mixture of a polymer compound and an organic metallic compound.

Examples of the polymer compound include an acetal resin, such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin and a melamine resin.

Examples of the fine particles to be dispersed in the polymer compound include a metallic oxide, such as zinc oxide and titanium oxide, a silicon compound, such as a silicone resin and silicon dioxide, and a fluorine compound, such as TEFLON. The fine particles preferably have a particle diameter of from 0.1 $\mu$m to 3 $\mu$m. The fine particles are generally contained in the undercoating layer in an amount of from 10% to 60% by weight, and preferably from 30% to 70% by weight. Upon preparing a coating composition for forming the undercoating layer, the fine particles is added to a solvent, in which the polymer compound has been dissolved, and then subjected to a dispersion treatment. Examples of the method for dispersing the fine particles in the polymer compound include a roll mill, a ball mill, a vibrating ball mill, an attritor, a sand mill, a colloid mill and a paint shaker.

Examples of the organic metallic compound to be mixed with the polymer compound include an organic metallic compound containing a silicon, zirconium, titanium, aluminum or manganese atom. The organic metallic compound may be used solely or as a mixture of plural kinds of the organic metallic compounds. Among these, an organic metallic compound containing a silicon atom or a zirconium atom is excellent in performance since it has a low residual potential to cause small fluctuation in potential depending on environments, and small fluctuation in potential due to repeated use.

The organic metallic compound containing a silicon atom is not particularly limited, and preferred examples thereof include a silane coupling agent, such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane and 3-chloropropyltrimethoxysilane.

Examples of the organic metallic compound containing a zirconium atom include zirconium butoxide, ethyl zirconium acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the organic metallic compound containing a titanium atom include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate and polyhydroxytitanium stearate.

Examples of the organic metallic compound containing an aluminum atom include aluminum isopropylate, monobutoxyaluminum diisopropylate, aluminum butyrate, diethylacetoacetate aluminum diisopropylate and aluminum tris (ethylacetoacetate).

The thickness of the undercoating layer 4 is preferably in a range of from 0.1 $\mu$m to 30 $\mu$m. In the case where the undercoating layer 4 is constituted with a polymer compound having fine particles, such as an metallic oxide, dispersed therein, the thickness thereof is preferably in a range of from 10 $\mu$m to 30 $\mu$m, and in the case where the undercoating layer is constituted with a polymer compound solely or with a mixture of a polymer compound and an organic metallic compound, the thickness thereof is preferably in a range of from 0.1 $\mu$m to 10 $\mu$m.

Charge Generating Layer

In general, the charge generating layer 1 is mainly constituted with a charge generating material and a binder resin. The charge generating material is not particularly limited as far as it has a charge generating function, and known materials can be used therefor. Specific examples of the charge generating material include a phthalocyanine compound, such as chlorogallium phthalocyanine, hydroxygallium phthalocyanine, titanyl phthalocyanine and nonmetallic phthalocyanine, a bisazo compound, a trisazo compound, a squalirium compound, and a pyrrolopyrrole compound.

Examples of the binder resin include a polycarbonate resin, such as a bisphenol A type, a bisphenol Z type and other types, a polyester resin, a methacrylic resin, an acrylic resin, a polyvinyl chloride resin, a polystyrene resin, a polyvinyl acetate resin, a styrene-butadiene copolymer resin, a vinylidene chloride-acrylonitrile copolymer resin, a vinyl chloride-vinyl acetate-maleic anhydride resin, a silicone resin, a silicone-alkyd resin, a phenol-formaldehyde resin, a styrene-alkyd resin and poly-N-vinyl carbazole. These binder resins may be used solely or as a mixture of two or more of them.

The charge generating material is preferably added in an amount of from 0.1 to 10 parts by weight per 100 parts by weight of the binder resin.

In order to prevent deterioration of the electrophotographic photoreceptor due to ozone and an oxidizing gas formed inside the electrophotographic apparatus or due to light and heat, it is preferred to add such an additive as an antioxidant, a photostabilizer and a heat stabilizer to the charge generating layer 1.

The antioxidant is not particularly limited, and known products can be used. Examples of the antioxidant include a phenol antioxidant, a hindered amine antioxidant, an organic sulfur antioxidant and an organic phosphorous antioxidant.

An organic sulfur antioxidant and an organic phosphorous antioxidant are referred to as a secondary antioxidant, and when it is used in combination with a primary antioxidant, such as the phenol series and the amine series, deterioration of the photoreceptor can be further prevented owing to the synergistic effect thereof.

Examples of the photostabilizer include a derivative of benzophenone series, benzotriazole series, dithiocarbamate series and tetramethylpiperidine series.

From the standpoint of improvement of the sensitivity, reduction of the residual potential and reduction of fatigue upon repeated use, the charge generating layer may contain one or more of an electron acceptive compound. Examples of the electron acceptive compound include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Among these, a fluorenone series, a quinone series and a benzene derivative having an electron attractive group, such as Cl, CN and $NO_2$, are particularly preferred.

The thickness of the charge generating layer is generally from 0.01 μm to 5 μm, and preferably from 0.05 μm to 2.0 μm.

The charge generating layer can be obtained by coating a coating composition for forming the charge generating layer on the electroconductive substrate or the undercoating layer, followed by drying. The coating composition for forming the charge generating layer can be obtained by dispersing the binder resin and the charge generating material in a solvent.

The solvent used is not particularly limited, and examples thereof include an alcohol, such as methanol, ethanol, isopropanol and n-butanol; a ketone, such as acetone, methyl ethyl ketone, cyclohexanone; an ether, such as tetrahydrofuran, dioxane, ethylene glycol monomethyl ether and diethyl ether; an aliphatic hydrocarbon halide, such as chloroform, dichloromethane, dichloroethane, carbon tetrachloride and trichloroethylene; an amide, such as N,N-dimethylformamide and N,N-dimethylacetamide; an ester, such as methyl acetate, ethyl acetate and n-butyl acetate; and an aromatic compound, such as benzene, toluene, xylene, monochlorobenzene and dichlorobenzene. These solvents may be used solely or as a mixture of two or more of them. A slight amount of a silicone oil as a leveling agent may be added to the coating composition for forming the charge generating layer for improving the smoothness.

Examples of the method for dispersing the charge generating material in the binder resin include a roll mill, a ball mill, a vibrating ball mill, an attritor, a DYNO mill, a sand mill and a colloid mill.

Coating of the coating composition for forming the charge generating layer may be carried out by such a coating method as a dip coating method, a ring coating method, a spray coating method, a bead coating method, a blade coating method and a roller coating method, depending on the shape and the purpose of the photoreceptor. Drying is preferably carried out by heat after drying to touch at room temperature. The drying by heat is preferably carried out at a temperature of from 30° C. to 200° C. for a period of from 5 minutes to 2 hours.

Charge Transporting Layer

Because the outermost layer used in the invention has a charge transporting function, it can be used as a charge transporting layer, as described in the foregoing. Since the outermost layer has been described, a charge transporting layer that is provided in the case where the outermost layer is provided as the overcoating layer on the charge transporting layer 2 will be described herein. The charge transporting layer in this case is generally constituted with a charge transporting material and a binder resin.

The charge transporting material is not particularly limited as far as it has a function of transporting charges, and examples thereof include a hole transporting substance, such as an oxadiazole derivative, a pyrazoline derivative, an aromatic tertiary amino compound, an aromatic tertiary diamino compound, a 1,2,4-triazine derivative, a hydrozone derivative, a quinazoline derivative, a benzofuran derivative, an α-stilbene derivative, an enamine derivative, a carbazole derivative, a poly-N-vinylcarbazole and a derivative thereof; an electron transporting substance, such as a quinone compound, a tetracyanoquinodimethane compound, a fluorenone compound, an oxadiazole compound, a xanthone compound, a thiophene compound and a diphenoquinone compound; and a polymer having a group derived from these compounds on a main chain or a side chain thereof. These charge transporting substances may be used solely or in combination of two or more of them.

The binder resin is not particularly limited, and examples thereof include a polycarbonate resin, a polyester resin, a polyarylate resin, a polyimide resin, a polyamide resin, a polystyrene resin, a silicon-containing crosslinked resin and a mixture thereof.

The charge transporting material is preferably added in an amount of from 20 to 1,000 parts by weight per 100 parts by weight of the binder resin.

The charge transporting layer 2 may contain the same additive as used in the charge generating layer 1, such as an antioxidant, a photostabilizer and a heat stabilizer, because of the same reasons as in the charge generating layer 1. The charge transporting layer 2 may contain one or more of an electron acceptive compound because of the same reasons as in the charge generating layer 1.

The thickness of the charge transporting layer 2 is generally from 5 μm to 50 μm, and preferably from 10 μm to 30 μm.

The charge transporting layer 2 can be obtained by coating a coating composition for forming the charge transporting layer on the electroconductive substrate 3 or the undercoating layer 4, followed by drying. The coating composition for forming the charge transporting layer can be obtained by dispersing the binder resin and the charge transporting material in a solvent.

As the solvent, those described as the solvents for the coating composition for forming the charge generating layer can be used.

Coating of the coating composition for forming the charge transporting layer can be carried out in the same coating methods as for the coating composition for forming the charge generating layer. Drying is preferably carried out by heat after drying to touch at room temperature. The drying by heat is preferably carried out at a temperature of from 30° C. to 200° C. for a period of from 5 minutes to 2 hours.

Layer Having Charge Generating Function and Charge Transporting Function

The layer having a charge generating function and a charge transporting function 6 is not particularly limited as far as it is constituted with materials having a charge generating function and a charge transporting function, and examples of the charge generating material and the charge transporting material include the charge generating materials and the charge transporting materials that are exemplified in the descriptions for the charge generating layer and the charge transporting layer. In the case where a film cannot be formed only with the charge generating material and the charge transporting material, a binder resin may be contained. Examples of the binder resin in this case include the binder resins that are exemplified in the descriptions for the charge generating layer and the charge transporting layer.

The thickness of the layer 6 is generally from 5 μm to 50 μm, and preferably from 10 μm to 40 μm.

The layer 6 can be obtained by coating a coating composition for forming the layer on the electroconductive substrate 3 or the undercoating layer 4, followed by drying. The coating composition can be obtained by dispersing the materials having a charge generating function and a charge transporting function and the binder resin in a solvent.

As the solvent, the same solvents as for the coating composition for forming the charge generating layer can be used.

Coating of the coating composition for forming the charge transporting layer can be carried out in the same coating methods as for the coating composition for forming the charge generating layer. Drying is preferably carried out by heat after drying to touch at room temperature. The drying by heat is preferably carried out at a temperature of from 30° C. to 200° C. for a period of from 5 minutes to 2 hours.

Electrophotographic Process Cartridge

Figure 9:
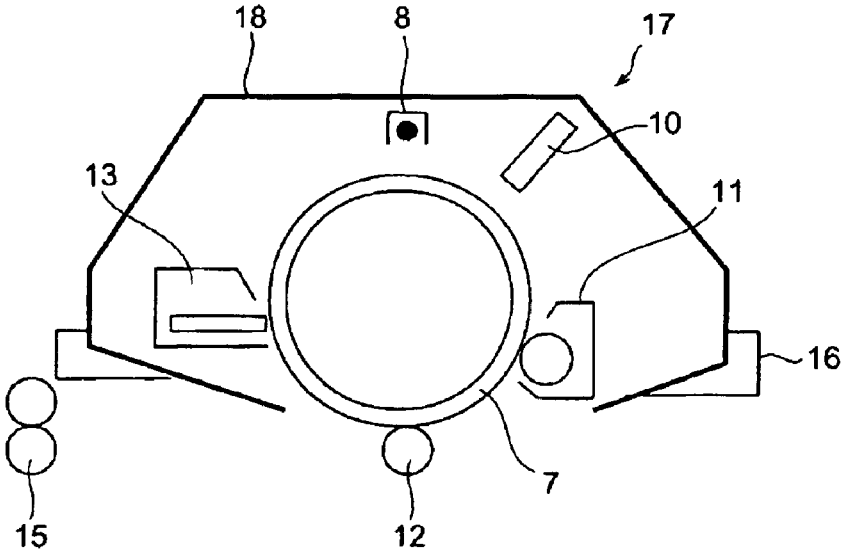
FIG. 9 is a schematic cross sectional view showing an electrophotographic apparatus equipped with an electrophotographic process cartridge according to the invention.

The electrophotographic process cartridge according to the invention will be described below. FIG. 9 is a schematic cross sectional view showing one example of an electrophotographic apparatus equipped with the electrophotographic process cartridge according to the invention. The electrophotographic apparatus shown in FIG. 9 has an electrophotographic apparatus main body, and the electrophotographic main body is constituted with a developing device 11, a transfer member 12, a fixing device 15 and an installation rail 16. The electrophotographic apparatus further has an electrophotographic process cartridge 17. The electrophotographic process cartridge 17 supports a housing 18 having therein an electrophotographic photoreceptor 7, a corona discharge charging device 8, an exposing device 10 and a cleaning device 13 integrated each other. The cleaning device 13 has a cleaning blade (cleaning member), and the cleaning blade is arranged to be made in contact with the surface of the electrophotographic photoreceptor 7. The electrophotographic process cartridge 17 is capable of being installed on the installation rail 16.

According to the electrophotographic process cartridge 17, in the case where it is installed in the electrophotographic apparatus main body to fabricate the electrophotographic apparatus, even though the cleaning blade of the cleaning device 13 is made in contact with the surface of the electrophotographic photoreceptor 7, occurrence of flaws on the surface of the electrophotographic photoreceptor 7 can be sufficiently prevented, and cracking of the cleaning blade is also sufficiently prevented. Therefore, occurrence of filming can be sufficiently prevented, and thus occurrence of defects on an image can be sufficiently prevented.

While the electrophotographic process cartridge 17 shown in FIG. 9 supports the housing 18 having therein the electrophotographic photoreceptor 7, the corona discharge charging device 8, the exposing device 10 and the cleaning device 13 integrated each other, it is sufficient that the electrophotographic process cartridge according to the invention supports the electrophotographic photoreceptor 7 and at least one of the charging device 8, the exposing device 10, the developing device 11 and the cleaning device 13. In the case where the electrophotographic apparatus is constituted with the electrophotographic process cartridge 17 and the electrophotographic apparatus main body, it is necessary that the electrophotographic apparatus has the developing device 11, the transfer member 12, the fixing device 15, the installation rail 16, the electrophotographic photoreceptor 7, the corona discharge charging device 8, the exposing device 10 and the cleaning device 13.

Electrophotographic Apparatus

Figure 10:
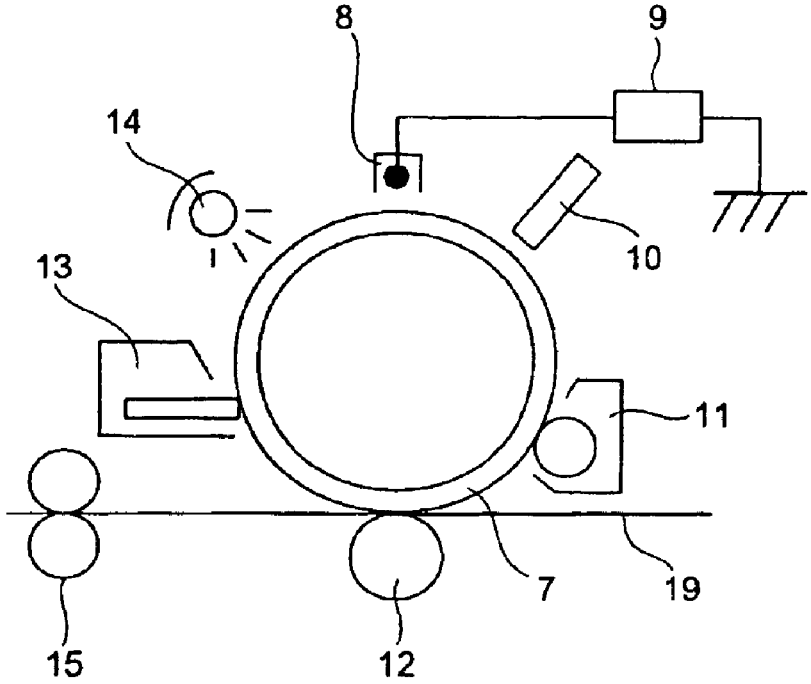
FIG. 10 is a schematic cross sectional view showing an embodiment of an electrophotographic apparatus according to the invention.

The electrophotographic apparatus according to the invention will be described below. FIG. 10 is a schematic cross sectional view showing one embodiment of an electrophotographic apparatus equipped with the electrophotographic photoreceptor according to the invention. As shown in FIG. 10, the electrophotographic apparatus has the electrophotographic photoreceptor 7, and a charging device 8, an exposing device 10, a developing device 11, a transferring device 12, a cleaning device 13 and a destaticizing device 14 are arranged around the electrophotographic photoreceptor 7 in this order along the rotating direction of the electrophotographic photoreceptor 7. The charging device 8 is applied with a potential by an electric power source 9. The cleaning device 13 has a cleaning blade, and the cleaning blade is arranged to be made in contact with the surface of the electrophotographic photoreceptor 7. In the figure, numeral 15 denotes a fixing device, and 19 denotes a transfer medium such as a sheet.

According to the electrophotographic apparatus, even though the cleaning blade of the cleaning device 13 is made in contact with the surface of the electrophotographic photoreceptor 7, occurrence of flaws on the surface of the electrophotographic photoreceptor 7 can be sufficiently prevented, and cracking of the cleaning blade is also sufficiently prevented. Therefore, occurrence of filming can be sufficiently prevented, and thus occurrence of defects on an image can be sufficiently prevented.

Figure 11:
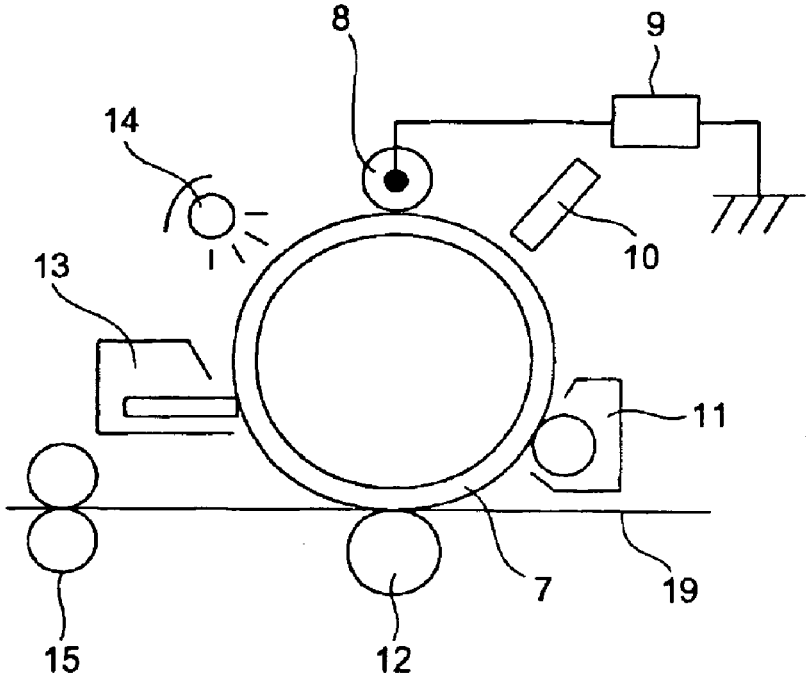
FIG. 11 is a schematic cross sectional view showing another embodiment of an electrophotographic apparatus according to the invention.

FIG. 11 is a schematic cross sectional view showing another embodiment of the electrophotographic apparatus according to the invention. The electrophotographic apparatus shown in FIG. 11 is different from the electrophotographic apparatus shown in FIG. 10 in such a point that a contact charging device 8 is used as a charging device. In this case, the contact charging device 8 has a charging member, such as a charging roller and a charging brush, and the charging member is made in contact with the surface of the electrophotographic photoreceptor 7. As the charging roller, for example, a roll member called rubbery BCR imparted with electroconductivity is employed.

Generally, in the case where charging is carried out by a contact charging method, filming may occur due to cracking of a charging member (such as a charging roller) of the contact charging device 8. However, because the electrophotographic photoreceptor 7 in this embodiment has a dynamic hardness of the outermost layer set at the particular value, cracking of the charging member is sufficiently prevented, and occurrence of filing can be sufficiently prevented, whereby defects on an image are sufficiently prevented. Therefore, a charging device of a contact charging type can be used in the electrophotographic apparatus of this embodiment without any problem.

When the contact charging device 8 is used, such an advantage can be obtained that ozone is difficult to be formed in comparison to the case where a charging device of a non-contact charging type, such as a corona charging type, is used, in addition to the advantage that defects on an image can be sufficiently prevented.

Furthermore, in the case where the contact charging device 8 is used in an electrophotographic apparatus, it is general that there is a tendency of increasing the electric current leakage. However, according to the electrophotographic apparatus of the invention, such favorable characteristics of less occurrence of electric current leakage can be obtained even in the case where a contact charging device is used as described in the foregoing.

While the electrophotographic apparatuses shown in FIGS. 10 and 11 have the destaticizing devices 14, it is not necessary that the electrophotographic apparatus of the invention has a destaticizing device.

Examples of the electrophotographic apparatus include a light lens system duplicator, a laser beam printer using a laser emitting near infrared light or visible light, a digital duplicator, an LED printer and a laser facsimile machine.

The electrophotographic apparatus may employ a one-component or two-component positive or negative developer.

EXAMPLES

The invention will be described in more detail with reference to the following examples, but the invention is not construed as being limited thereto.

Production of Electrophotographic Photoreceptor

Base Photoreceptor A

An aluminum substrate having an outer diameter of 84 mm and a length of 343 mm having been subjected to a honing treatment is prepared.

20 parts by weight of a zirconium compound (Orgatix ZC540, a trade name, produced by Matsumoto Chemical Industry Co., Ltd.), 2.5 parts by weight of a silane compound (A1100, a trade name, produced by Nippon Unicar Co., Ltd.), 10 parts by weight of a polyvinyl butyral resin (S-Lec BM-S, a trade name, produced by Sekisui Chemical Co., Ltd.) and 45 parts by weight of butanol are mixed by stirring to obtain a coating composition for an forming undercoating layer. The coating composition is coated on the aluminum substrate by a dip coating method and dried by heating at 150° C. for 10 minutes, so as to obtain an undercoating layer having a thickness of 1.0 $\mu$m.

1 part by weight of chlorogallium phthalocyanine having strong diffraction peaks at Bragg angles (2θ±0.2°) of 7.4°, 16.6°, 25.5° and 28.3° in an X-ray diffraction spectrum using a CuKα line, as a charge generating material, 1 part by weight of a polyvinyl butyral resin (S-Lec BM-S, a trade name, produced by Sekisui Chemical Co., Ltd.) and 100 parts by weight of n-butyl acetate are mixed, and the resulting mixture is then subjected to a dispersion treatment in a paint shaker along with glass beads for 1 hour, so as to obtain a dispersion for forming a charge generating layer. The dispersion is coated on the undercoating layer by a dip coating method and dried at 100° C. for 10 minutes, so as to obtain a charge generating layer having a thickness of 0.15 $\mu$m.

2 parts by weight of a compound represented by the following structural formula (1) and 3 parts by weight of a polymer compound (viscosity average molecular weight: 39,000) represented by the following structural formula (2) are dissolved in 20 parts by weight of chlorobenzene, so as to obtain a coating composition for forming a charge transporting layer.

(1)

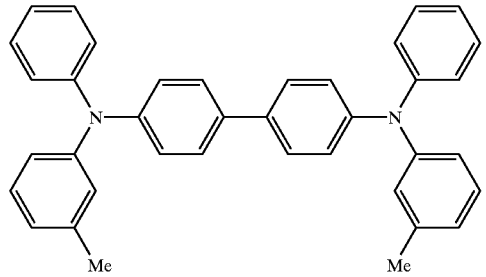

(2)

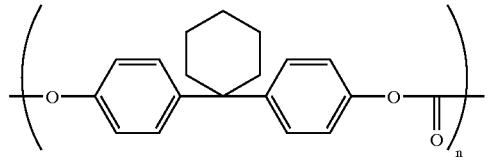

The resulting coating composition is coated on the charge generating layer by a dip coating method and dried at 110° C. for 40 minutes, so as to obtain a charge transporting layer having a thickness of 20 $\mu$m. The photoreceptor thus obtained is designated as a base photoreceptor A.

Photoreceptor 1

2 parts by weight of the following compound (3), 2 parts by weight of the following compound (4), 0.05 part by weight of tetramethoxysilane are dissolved in 5 parts by weight of isopropyl alcohol, 3 parts by weight of tetrahydrofuran and 0.3 part by weight of distilled water, to which 0.05 part by weight of an ion exchange resin (AMBERLIST 15E, a trade name, produced by Rohm and Hass, Inc.) is added, followed by stirring at room temperature to carry out hydrolysis for 24 hours.

(3)

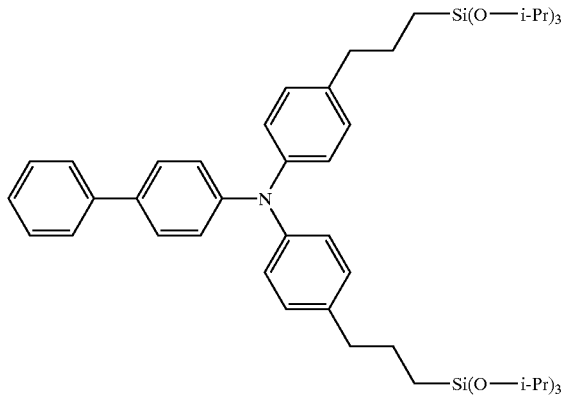

(4)

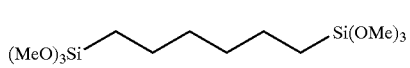

The ion exchange resin is separated by filtration from the resulting liquid, and 0.04 part by weight of aluminum triacetylacetonate and 0.02 part by weight of 3,5-di-tert-butyl-4-hydroxytoluene are added to 2 parts by weight of the resulting filtrate, so as to obtain a coating composition for forming a surface protective layer A.

The coating composition for forming a surface protective layer A is coated on the base photoreceptor A by a dip coating method and dried in air for 30 minutes, followed by curing under heating at 150° C. for 1 hour. A surface protective layer having a thickness of about 3 $\mu$m is thus formed to obtain a photoreceptor 1.

Photoreceptors 2 to 4

Photoreceptors 2 to 4 are produced in the same manner as in the production of the photoreceptor 1 except that the following compounds (5) to (7) are used, respectively, for forming a surface protective layer instead of the compound (4) used upon production of the surface protective layer of the photoreceptor 1.

(5)

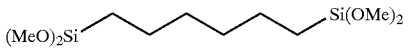

(6)

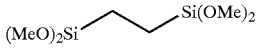

(7)

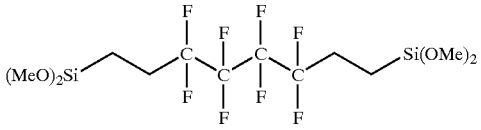

Photoreceptor 5

A photoreceptor 5 is produced in the same manner as in the production of the photoreceptor 1 except that the following compound (8) is used for forming a surface protective layer instead of the compound (3) used upon production of the surface protective layer of the photoreceptor 1.

(8)

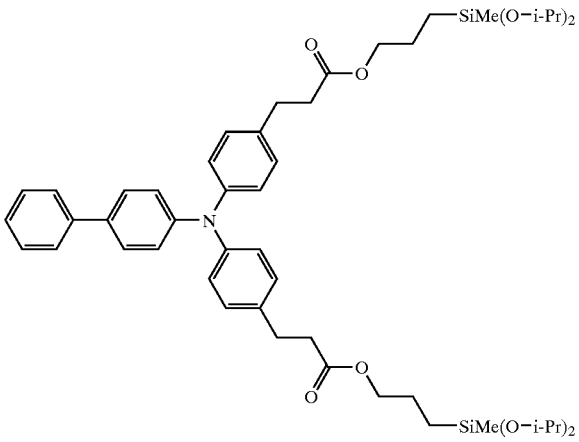

Photoreceptors 6 to 8

Photoreceptors 6 to 8 are produced in the same manner as in the production of the photoreceptor 5 except that the compounds (5) to (7) are used, respectively, for forming a surface protective layer instead of the compound (4) used upon production of the surface protective layer of the photoreceptor 5.

Photoreceptor 9

10 parts by weight of a resin formed from 80% by mole of a methylsiloxane unit and 20% by mole of a dimethylsiloxane unit and containing 1% by weight of a silanol group is dissolved in 8 parts by weight of toluene, to which 3.0 parts by weight of methyltrisiloxane and 0.2 part by weight of dibutyltin diacetate are added to obtain a solution. 20 part by weight of toluene and 4 parts by weight of 4-(N,N-bis(3,4-dimethylphenyl)amino)-(2-(triethoxysilyl)ethyl) benzene are added to 10 parts by weight of the solution to obtain a coating composition for forming a surface protective layer. The coating composition is coated on the surface of the base photoreceptor A by a spray coating method. It is then dried in air at 120° C. for 10 minutes and then cured by heating at 150° C. for 2 hours. Thus, a surface protective layer having a thickness of about 3 μm is formed to obtain a photoreceptor 9.

Photoreceptor 10

A photoreceptor 10 is produced in the same manner as in the production of the photoreceptor 9 except that the addition amount of methyltrisiloxane is changed from 3.0 parts by weight to 10.0 parts by weight.

Measurement of Dynamic Hardness of Surface Layer

The photoreceptors 1 to 10 each is set on a Ultra micro hardness tester (DUH-201, produced by Shimadzu Corp.) equipped with a diamond penetrator having a tip angle of 115° and a tip curvature radius of 0.07 μm, and the hardness of the surface of the photoreceptor is measured in a penetrator compressing mode. The compressing pressure at this time is 0.05 mN/sec. The hardness is calculated in the region of a depth of 1.0 μm or less, where no influence is applied from the base, by using the following equation (1), and the calculated value is designated as a dynamic hardness of the surface protective layer:

$$DH=3.8584\times(P/D^2) \quad (1)$$

wherein DH represents the dynamic hardness ($N/m^2$), P represents the penetrating load (N), and D represents the penetrating depth (m).

Examples 1 to 8

In Examples 1 to 8, the photoreceptors 1 to 8 each is installed in a contact charging type color printer (DOCUPRINT C625PS, produced by Fuji Xerox Co., Ltd.) as a photoreceptor therefor. At this time, cerium oxide fine particles (volume average particle diameter: 0.65 μm) as an abrasive are dispersed in a toner. The cerium oxide fine particles are added in an amount of 1.5 parts by weight per 100 parts by weight of the toner.

A printing test of 30,000 sheets is carried out for the respective photoreceptors 1 to 8. After the test, filming attached on the surface of the photoreceptor is evaluated with the naked eye, and the printed image quality is evaluated with the naked eye. The results are shown in Table 1 below. In Table 1, the evaluations of filming and printed image quality are shown in the following grades. The case where filming does not occur or slightly occurs but can be ignored is shown by A, and the case where filming frequently occurs is shown by B. With respect to the printed image quality, the case where no defect is found on the image is shown by A, and the case where defects are found on the image is shown by B.

TABLE 1

| | | Dynamic hardness of outermost layer ($N/m^2$) | Filming | Image quality |
|---|---|---|---|---|
| Example 1 | Photoreceptor 1 | $28.3 \times 10^9$ | A | A |
| Example 2 | Photoreceptor 2 | $19.5 \times 10^9$ | A | A |
| Example 3 | Photoreceptor 3 | $23.5 \times 10^9$ | A | A |
| Example 4 | Photoreceptor 4 | $25 \times 10^9$ | A | A |
| Example 5 | Photoreceptor 5 | $28.3 \times 10^9$ | A | A |
| Example 6 | Photoreceptor 6 | $18.3 \times 10^9$ | A | A |
| Example 7 | Photoreceptor 7 | $23.8 \times 10^9$ | A | A |
| Example 8 | Photoreceptor 8 | $13 \times 10^9$ | A | A |
| Comparative Example 1 | Photoreceptor 9 | $8.0 \times 10^9$ | B | B |
| Comparative Example 2 | Photoreceptor 10 | $145.0 \times 10^9$ | B | B |

Comparative Example 1

A printing test is carried out in the same manner as in Example 1 except that the photoreceptor 9 is used instead of the photoreceptor 1 in Example 1. After the test, filming attached on the surface of the photoreceptor 9 is evaluated with the naked eye, and the printed image quality is evaluated with the naked eye. The results are shown in Table 1.

Comparative Example 2

A printing test is carried out in the same manner as in Example 1 except that the photoreceptor 10 is used instead of the photoreceptor 1 in Example 1. After the test, filming attached on the surface of the photoreceptor 10 is evaluated with the naked eye, and the printed image quality is evaluated with the naked eye. The results are shown in Table 1.

It is clear from Table 1 that, according to Examples 1 to 8, after long-term use of a photoreceptor, filming does not occur or is extremely slight even when it occurs, and the image quality is good as no defect is found on the image.

According to Comparative Example 1, on the other hand, it is found that filming frequently occurs after long-term use due to flaws formed on the surface of the photoreceptor, and deterioration of the image quality arises. According to Comparative Example 2, it is found that the cleaning blade is cracked, whereby filming frequently occurs due to scraping of the external additive of the toner through the cracked part, and deterioration of the image quality arises.

As described in the foregoing, according to the electrophotographic photoreceptor, and the electrophotographic process cartridge and the electrophotographic apparatus using the same, occurrence of flaws on the surface of the photoreceptor can be sufficiently prevented, and cracking of a member made in contact with the photoreceptor can also be sufficiently prevented. Therefore, occurrence of filming is sufficiently prevented, and occurrence of defects on an image is also sufficiently prevented.

The entire disclosure of Japanese Patent Application No. 2001-123363 filed on Apr. 20, 2001 including specification, claims, drawings and abstract is incorporated herein by reference in its entirety.

What is claimed is:

1. An electrophotographic photoreceptor, comprising an electroconductive substrate having provided thereon a photosensitive layer, an outermost layer of the photosensitive layer having a dynamic hardness of from $20.0\times10^9$ to $100.0\times10^9$ N/m$^2$;

wherein the dynamic hardness is a value calculated by the following equation (1) using a penetration load and a penetrating depth when a diamond penetrator having a tip angle of 115° and a tip curvature radius of 0.1 $\mu$m or less is penetrated onto the outermost layer of the electrophotographic photoreceptor with a stress velocity of 0.05 mN/sec:

$$DH=3.8584\times(P/D^2) \quad (1)$$

wherein DH represents the dynamic hardness (N/m$^2$), P represents the penetrating load (N), and D represents the penetrating depth (m).

2. The electrophotographic photoreceptor as claimed in claim 1, wherein the dynamic hardness is about from $20.0\times10^9$ to $70.0\times10^9$ N/m$^2$.

3. The electrophotographic photoreceptor as claimed in claim 1, wherein the dynamic hardness is from $20.0\times10^9$ to $50.0\times10^9$ N/m$^2$.

4. The electrophotographic photoreceptor as claimed in claim 1, wherein the outermost layer of the electrophotographic photoreceptor contains a three-dimensionally crosslinked silicone resin and has a charge transporting function.

5. The electrophotographic photoreceptor as claimed in claim 1, wherein the outermost layer of the electrophotographic photoreceptor contains a three-dimensionally crosslinked silicone resin having a charge transporting organic group.

6. An electrophotographic process cartridge, comprising an electrophotographic photoreceptor and at least one device selected from the group consisting of a charging device, an exposing device, a developing device and a cleaning device, integrated with each other, the process cartridge being detachable on an electrophotographic apparatus main body, the electrophotographic photoreceptor, comprising an electroconductive substrate having provided thereon a photosensitive layer, an outermost layer of the photosensitive layer having a dynamic hardness of from $20.0\times10^9$ to $100.0\times10^9$ N/m$^2$;

wherein the dynamic hardness is a value calculated by the following equation (1) using a penetration load and a penetrating depth when a diamond penetrator having a tip angle of 115° and a tip curvature radius of 0.1 $\mu$m or less is penetrated onto the outermost layer of the electrophotographic photoreceptor with a stress velocity of 0.05 mN/sec:

$$DH=3.8584\times(P/D^2) \quad (1)$$

wherein DH represents the dynamic hardness (N/m$^2$), P represents the penetrating load (N), and D represents the penetrating depth (m).

7. The electrophotographic process cartridge as claimed in claim 6, wherein the outermost layer of the electrophotographic photoreceptor contains a three-dimensionally crosslinked silicone resin and has a charge transporting function.

8. The electrophotographic process cartridge as claimed in claim 6, wherein the outermost layer of the electrophotographic photoreceptor contains a three-dimensionally crosslinked silicone resin having a charge transporting organic group.

9. An electrophotographic apparatus comprising an electrophotographic photoreceptor, a charging device that charges a surface of the electrophotographic photoreceptor, an exposing device that exposes a surface of the electrophotographic photoreceptor to form an electrostatic latent image, a developing device that develops the electrostatic latent image, a transferring device that transfers an image thus developed to a transfer medium, and a cleaning device being arranged to be made in contact with the surface of the electrophotographic photoreceptor after transferring and having a cleaning member that cleans the surface, the electrophotographic photoreceptor comprising an electroconductive substrate having provided thereon a photosensitive layer, an outermost layer of the photosensitive layer having a dynamic hardness of about from $20.0\times10^9$ to $100.0\times10^9$ N/m$^2$;

wherein the dynamic hardness is a value calculated by the following equation (1) using a penetration load and a penetrating depth when a diamond penetrator having a tip angle of 115° and a tip curvature radius of 0.1 $\mu$m or less is penetrated onto the outermost layer of the electrophotographic photoreceptor with a stress velocity of 0.05 mN/sec:

$$DH=3.8584\times(P/D^2) \quad (1)$$

wherein DH represents the dynamic hardness ($N/m^2$), P represents the penetrating load (N), and D represents the penetrating depth (m).

10. The electrophotographic apparatus as claimed in claim 9, wherein the charging device has a charging member that is arranged to be made in contact with the surface of the electrophotographic photoreceptor to charge the surface.

11. The electrophotographic apparatus as claimed in claim 9, wherein the outermost layer of the electrophotographic photoreceptor contains a three-dimensionally crosslinked silicone resin and has a charge transporting function.

12. The electrophotographic apparatus as claimed in claim 9, wherein the outermost layer of the electrophotographic photoreceptor contains a three-dimensionally crosslinked silicone resin having a charge transporting organic group.

* * * * *